US011454454B2

(12) United States Patent
Liu et al.

(10) Patent No.: US 11,454,454 B2
(45) Date of Patent: Sep. 27, 2022

(54) FLAT HEAT PIPE STRUCTURE

(71) Applicant: COOLER MASTER CO., LTD., New Taipei (TW)

(72) Inventors: Leilei Liu, Huizhou (CN); Xuemei Wang, Huizhou (CN)

(73) Assignee: COOLER MASTER CO., LTD., New Taipei (TW)

( * ) Notice: Subject to any disclaimer, the term of this patent is extended or adjusted under 35 U.S.C. 154(b) by 0 days.

(21) Appl. No.: 16/654,953

(22) Filed: Oct. 16, 2019

(65) Prior Publication Data

US 2020/0049420 A1 Feb. 13, 2020

Related U.S. Application Data

(63) Continuation-in-part of application No. 13/417,898, filed on Mar. 12, 2012, now Pat. No. 10,598,442.

(51) Int. Cl.
*F28D 15/04* (2006.01)
*F28D 15/02* (2006.01)

(52) U.S. Cl.
CPC ..... *F28D 15/04* (2013.01); *F28D 15/0233* (2013.01)

(58) Field of Classification Search
CPC .. F28D 15/02; F28D 15/0233; F28D 15/0266; F28D 15/04; F28D 15/046; H01L 23/427
(Continued)

(56) References Cited

U.S. PATENT DOCUMENTS 3,255,702 A 6/1966 Gehrm
4,058,160 A 11/1977 Corman et al.
(Continued)

FOREIGN PATENT DOCUMENTS

JP 2000161878 A * 6/2000 ..... F28D 15/0233
JP 2004251544 A * 9/2004 ..... F28D 15/0233
(Continued)

OTHER PUBLICATIONS

Non-Final Office Action dated Nov. 5, 2020 in U.S. Appl. No. 16/422,562.
(Continued)

*Primary Examiner* — Jianying C Atkisson
*Assistant Examiner* — For K Ling
(74) *Attorney, Agent, or Firm* — McDermott Will & Emery LLP

(57) ABSTRACT

A vapor chamber having a working fluid therein, includes a first and second casing, together forming an evaporator section having a plurality of first support structures therein, a condenser section having a plurality of second support structures therein, and a vapor flow chamber extending from the evaporator section to the condenser section is provided. The evaporator section further includes a plurality of extended heat transfer structures therein, contacting a first inner surface of the evaporator section of the first casing and being perpendicular thereto. The vapor flow chamber includes as least one evaporator vapor flow area. The first inner surface, second inner surface of the first and second casings, plurality of extended heat transfer structures, and at least one of a plurality of first support structures include evenly distributed and substantially the same thickness sintered powdered wick structures thereon. The plurality of first and second support structures supports the first and second casings of the vapor chamber.

13 Claims, 14 Drawing Sheets

(58) Field of Classification Search
USPC ..... 165/104.26
See application file for complete search history.

(56) References Cited

U.S. PATENT DOCUMENTS 4,116,266 A * 9/1978 Sawata ..... F28D 15/046 122/366
4,118,756 A * 10/1978 Nelson ..... F28D 15/0233 165/104.26
4,770,238 A 9/1988 Owen
5,465,782 A 11/1995 Sun et al.
6,738,257 B1 5/2004 Lai
6,745,825 B1 6/2004 Nakamura et al.
6,796,373 B1 9/2004 Li
6,938,680 B2 9/2005 Gamer et al.
7,249,627 B2 * 7/2007 Choi ..... F28D 15/0233 165/104.21
7,275,588 B2 10/2007 Hsu
7,278,469 B2 10/2007 Sasaki et al.
7,443,677 B1 10/2008 Zhou et al.
7,845,394 B2 12/2010 Chang et al.
8,256,501 B2 9/2012 Nagai et al.
8,780,559 B2 7/2014 Weaver, Jr. et al.
8,811,014 B2 8/2014 Chauhan et al.
10,048,015 B1 8/2018 Lin
2003/0010477 A1 1/2003 Khrustalev et al.
2004/0067414 A1 4/2004 Wei et al.
2005/0092465 A1 5/2005 Lin et al.
2005/0173098 A1 8/2005 Connors
2005/0178532 A1 8/2005 Meng-Cheng et al.
2006/0162905 A1 7/2006 Hsu
2007/0193723 A1 8/2007 Hou et al.
2007/0240855 A1 10/2007 Hou et al.
2007/0272399 A1 11/2007 Nitta et al.
2008/0036076 A1 2/2008 Ouyang
2008/0144319 A1 6/2008 Chang et al.
2009/0004902 A1 * 1/2009 Pandey ..... H01L 23/427 439/331
2009/0025910 A1 1/2009 Hoffman et al.
2009/0101308 A1 4/2009 Hardesty
2009/0250196 A1 * 10/2009 Batty ..... F28D 15/0233 165/104.26
2009/0323276 A1 * 12/2009 Mongia ..... G06F 1/203 361/679.52
2010/0051239 A1 3/2010 Lin et al.
2010/0149755 A1 * 6/2010 Tomioka ..... F28D 15/043 361/700
2010/0326629 A1 12/2010 Meyer, IV et al.
2011/0000649 A1 1/2011 Joshi et al.
2011/0030921 A1 2/2011 Zhang et al.
2011/0088877 A1 4/2011 Oniki et al.
2011/0174464 A1 7/2011 Liu et al.
2011/0220328 A1 9/2011 Huang et al.
2012/0111541 A1 5/2012 Yan et al.
2012/0305222 A1 12/2012 Yang et al.
2013/0037242 A1 2/2013 Chen et al.
2013/0126139 A1 * 5/2013 Tsuruta ..... F28F 3/12 165/170
2013/0168050 A1 * 7/2013 Chauhan ..... H01L 23/427 165/104.21
2013/0340978 A1 12/2013 Agostini et al.
2014/0182819 A1 7/2014 Yang
2014/0311713 A1 10/2014 Wu et al.
2015/0083372 A1 3/2015 Yang
2015/0101784 A1 4/2015 Pai
2015/0204617 A1 7/2015 Thanhlong et al.
2016/0003555 A1 1/2016 Sun et al.
2016/0018166 A1 1/2016 Ahamed et al.
2016/0348985 A1 12/2016 Sun et al.
2017/0122672 A1 5/2017 Lin
2017/0153066 A1 6/2017 Lin et al.
2017/0176112 A1 6/2017 Sarraf et al.
2017/0227298 A1 8/2017 Sun et al.
2017/0241717 A1 8/2017 Sun et al.
2017/0292793 A1 10/2017 Sun et al.
2017/0312871 A1 11/2017 Lin
2017/0343297 A1 11/2017 Lan
2017/0350657 A1 12/2017 Yeh et al.
2017/0356694 A1 12/2017 Tan et al.
2018/0023416 A1 1/2018 Riaz et al.
2018/0066896 A1 3/2018 Lin
2018/0350718 A1 12/2018 Lin
2019/0049190 A1 2/2019 Liu et al.
2019/0195567 A1 6/2019 Wang et al.

FOREIGN PATENT DOCUMENTS

JP 2004309002 A * 11/2004 ..... F28F 3/14
JP 2007150013 A * 6/2007 ..... F28D 15/046
JP 2007-266153 A 10/2007
TW 577538 U 2/2004
TW 092205365 2/2004
TW 201623901 A 7/2016
TW I639379 B 10/2018
WO WO-2011130748 A2 * 10/2011 ..... F28D 15/0233
WO 2017195254 A1 11/2017

OTHER PUBLICATIONS

Chapter 5: Heat Pipe Manufacturing—Bahman Zohuri (Apr. 2016) (Year: 2016).
Non-Final Office Action dated Nov. 12, 2020 in U.S. Appl. No. 16/119,707.
Non-Final Office Action issued in U.S. Appl. No. 16/119,707, dated Sep. 27, 2021.

* cited by examiner

FLAT HEAT PIPE STRUCTURE

CROSS-REFERENCE TO RELATED APPLICATIONS

This non-provisional application is a continuation-in-part application of U.S. application Ser. No. 13/417,898, filed on Mar. 12, 2012, the entire contents of this application is hereby incorporated by reference.

BACKGROUND

1. Field

Embodiments disclosed are directed to a flat heat pipe structure, and more particularly, to a heat-moving flat heat pipe structure having internal support members.

2. Descriptions of Related Art

As the operating frequency a circuit (e.g., a central processing unit (CPU)) increases, heat generated by the circuit also increases. Dissipation of the increased heat using conventional heat dissipating devices including an aluminum heat sink and a fan is challenging. To address this issue, more powerful and capable heat pipes and vapor chambers have been developed to work with the heat sink.

Due to adhesive characteristic of the porous capillary structure of the heat pipe and pressure differential across its walls, a support member is required to be disposed in the heat pipe, such that the tubing structure does not collapse after being flattened and during operation. However, the conventional support member is very rigid and such a tubing hard to bend. Existing support members include saw tooth-shaped ridges. However, the capillary structure or the tubing may be worn and/or damaged by these saw tooth-shaped ridges. Some of other existing support members have complex structural features. When these types of support members are disposed in heat pipes, the flow of the working fluid in the heat pipe is impeded, which adversely affects the heat dissipation efficiency.

SUMMARY

Various aspects of the present disclosure provide a cooling apparatus for dissipating heat generated by electronic components.

According to an aspect of the present disclosure, embodiments are directed to a heat dissipation device that includes a first plate, a second plate contacting the first plate, and at least partially defining a heat exchange chamber therebetween. The heat dissipation device further includes a mesh disposed in the heat exchange chamber. The second plate includes a first plurality of columns, a second plurality of columns, and a plurality of ridges between the first and second plurality of columns. The first plurality of columns, the second plurality of columns, and the plurality of ridges are disposed in the heat exchange chamber.

BRIEF DESCRIPTION OF THE DRAWINGS

The following figures are included to illustrate certain aspects of the embodiments, and should not be viewed as exclusive embodiments. The subject matter disclosed is capable of considerable modifications, alterations, combinations, and equivalents in form and function, as will occur to those skilled in the art and having the benefit of this disclosure.

It should be understood that the drawings are not to scale and that the disclosed embodiments are sometimes illustrated diagrammatically and in partial views. In certain instances, details that are not necessary for an understanding of the disclosed method and apparatus, or that would render other details difficult to perceive can have been omitted. It should be understood that the present application is not limited to the particular embodiments illustrated herein.

DETAILED DESCRIPTION

To attain further understanding of the objectives, structural features, and functions of the instant disclosure, please refer to the detailed descriptions provided hereinbelow.

Figure 1:
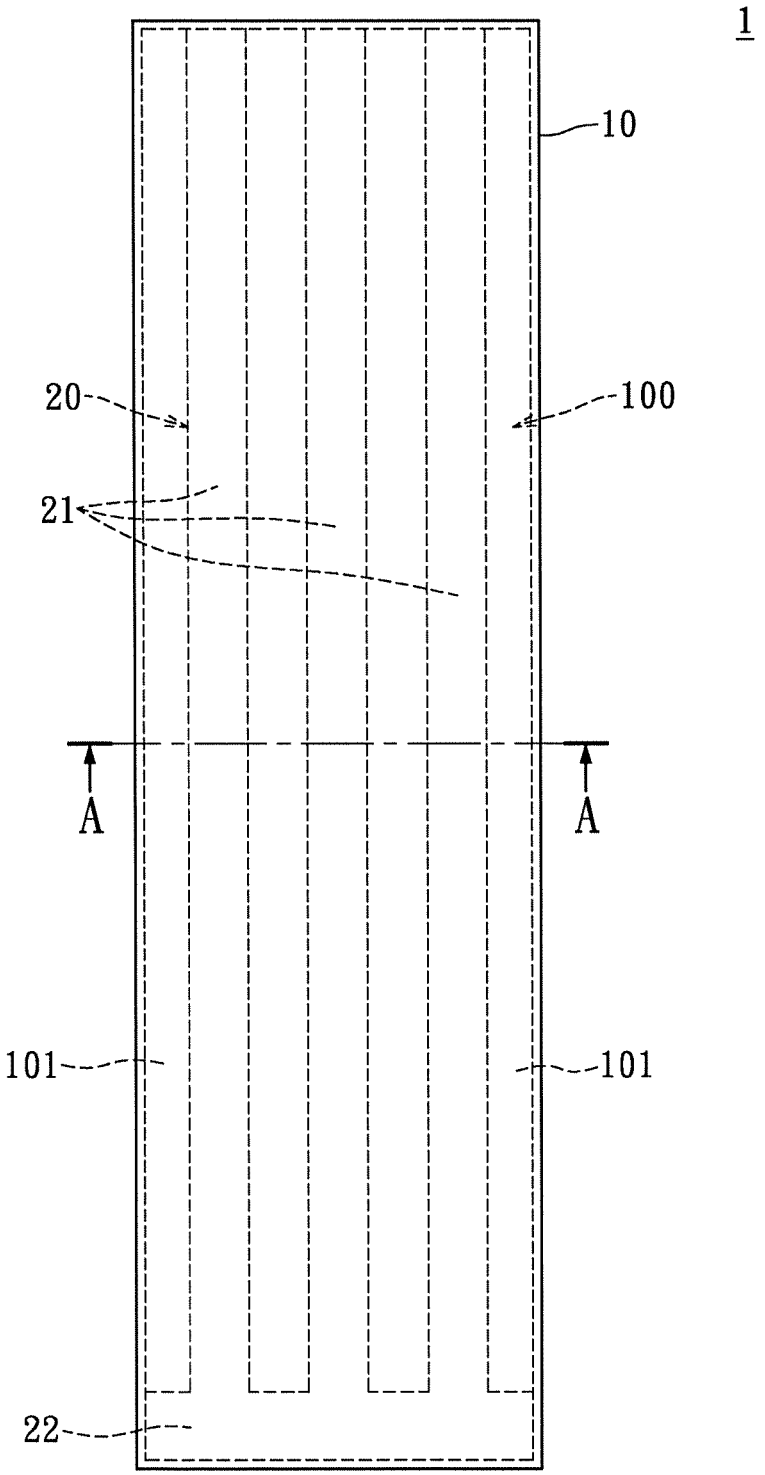
FIG. 1 is a top view of a flat heat pipe structure of the instant disclosure.
Figure 1A:
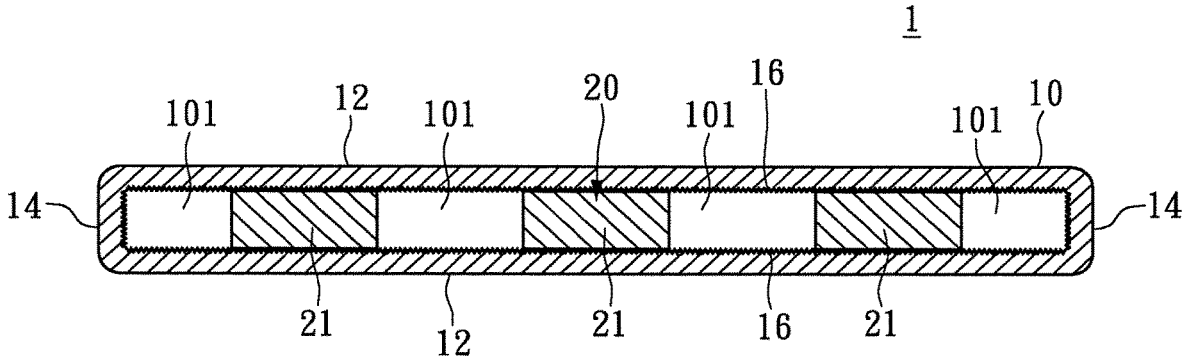
FIG. 1A is a cross-sectional view of the flat heat pipe structure in FIG. 1 taken along line AA.

FIG. 1 shows a top view of a flat heat pipe structure 1 of the instant disclosure, and FIG. 1A shows a cross-sectional view thereof taken along line AA in FIG. 1. The flat heat pipe structure 1 comprises a flat tubing 10 and a support member 20 disposed therein. The flat tubing 10 is made with material with excellent thermal conductivity and malleability such as aluminum, aluminum alloy, copper, copper alloy, etc. The flat tubing 10 is manufactured by flattening an annular tubing. For the instant embodiment, the flat tubing 10 is elongated and has a strip-like shape. Alternatively, the flat tubing 10 may be rectangular with a plate-like shape, where the exact structural shape of the flat tubing 10 is not restricted.

The flat tubing 10 is defined by two opposed main walls 12 and two opposed connecting walls 14. The connecting walls 14 are connected between the main walls 12 and cooperatively form an internal space 100. The opposite ends of the flat tubing 10 are welded closed to seal the flat tubing 10. A capillary structure 16 is formed on the inner surfaces of the flat tubing 10. Namely, the capillary structure 16 covers the inner surfaces of the main and connecting walls 12 and 14 for transporting the working fluid (not shown). The capillary structure 16 may be provided in various forms such as a metal mesh, grooves, or a sintered body of metal powder.

The support member 20 is preferably made of high temperature resistant and bendable material, such as copper. The support member 20 has at least one support arm 21 disposed in the internal space 100 of the flat tubing 10. For the instant embodiment, the support member 20 has three support arms 21 arranged in parallel to each other. Each support arm 21 extends along the longitudinal direction or the long axis of the flat tubing 10. At least one support arm 21 has two opposed flat surfaces, namely, a top surface and a bottom surface, for the orientation shown in FIG. 1A. The top and bottom surfaces abut the capillary structure 16 of the main walls 12. The support arms 21 serve as structural supports for the flat tubing 10. Moreover, the support arms 21 and the flat tubing 10 cooperatively form a plurality of passageways 101, where the passageways 101 are arranged in parallel to each other and extend longitudinally along the flat tubing 10.

The opposite sides of the support member 20 extending in the longitudinal direction of the flat tubing 10 are spaced apart from the connecting walls 14 by a predetermined distance. In other words, the support arms 21 do not touch the connecting walls 14. The spaces formed between the support arms 21 and the connecting walls 14 along the longitudinal direction of the flat tubing 10 serve as internal passageways 101. The passageways 101 are in communication with both ends of the flat heat pipe structure 1. One end of the flat heat pipe structure 1 being the evaporator section for absorbing heat, and the other end being the condenser section for giving up latent heat of vaporization. At the condenser section, the working fluid changes from a vapor state to a liquid state. These longitudinal passageways 101 provide the shortest distance that the working fluid has to travel between opposite ends of the flat heat pipe structure 1, thus greatly raising the heat dissipation efficiency. It is worth noting the support arms 21 of the support member 20 may also be arranged touchingly to the respective connecting walls 14, for preventing the connecting walls 14 from deforming inwardly and crimping after bending.

Figure 2:
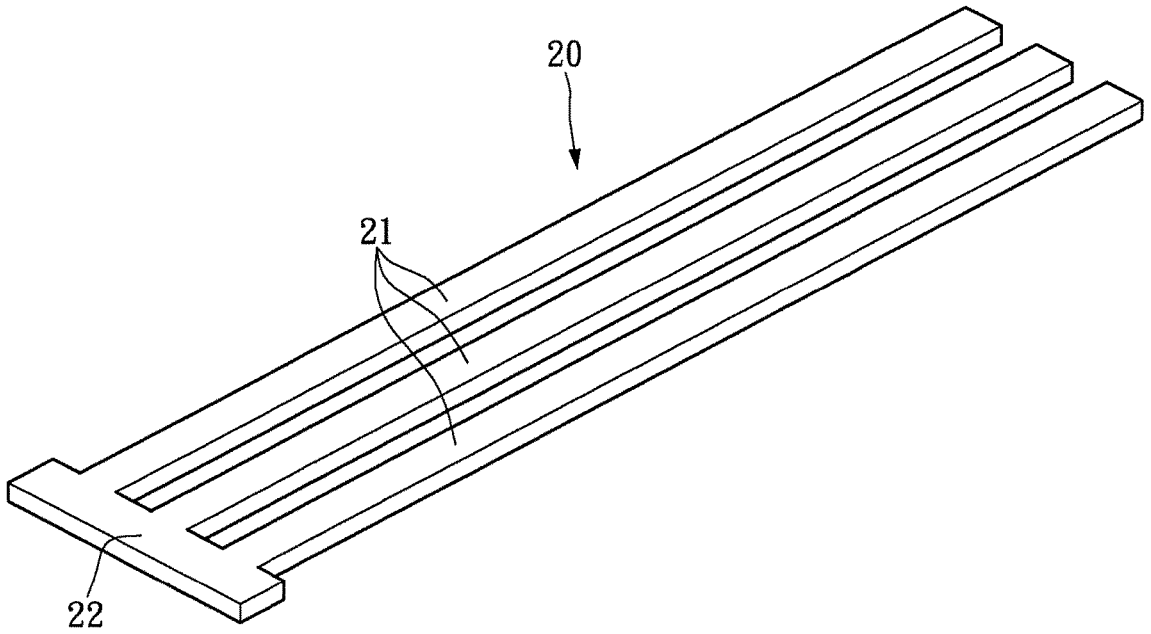
FIG. 2 is a perspective view of a support member for the flat heat pipe structure of the instant disclosure.

Please refer to FIG. 2, which is a perspective view showing the support member 20 of the flat heat pipe structure 1. As described previously, the support member 20 of the instant embodiment has three support arms 21. The support arms 21 are parallelly spaced apart from one another, where the number of support arms 21 is not restricted. The support member 20 may have more than one support arm 21, where the support arms 21 are equally spaced from one another inside the flat tubing 10. The distance between adjacent support arms 21 depends on the dimension of the flat tubing 10 along the short axis of the flat tubing 10. The support member 20 further has a connecting portion 22 connecting to one end of each support arm 21. The width of the connecting portion 22 is substantially equal to or less than the width of the internal space 100 along the short axis of the flat tubing 10. Furthermore, the opposite ends of the connecting portion 22 do not have to extend normally beyond the support arms 21. The purpose of the connecting portion 22 is to maintain the support arms 21 spaced apart from each other. Especially after the support arms 21 have been disposed in the annular tubing, the connecting portion 22 prevents the misplacing of the support arms 21 during the flattening process. For the instant embodiment, the shape of the connecting portion 22 is rectangular but is not restricted thereto. For example, the connecting portion 22 may be a rod-shaped structure. Alternatively, the support member 20 may have two connecting portions 20. The second connecting portion 20 may be arranged on the other end of each support arm 21.

Figure 3:
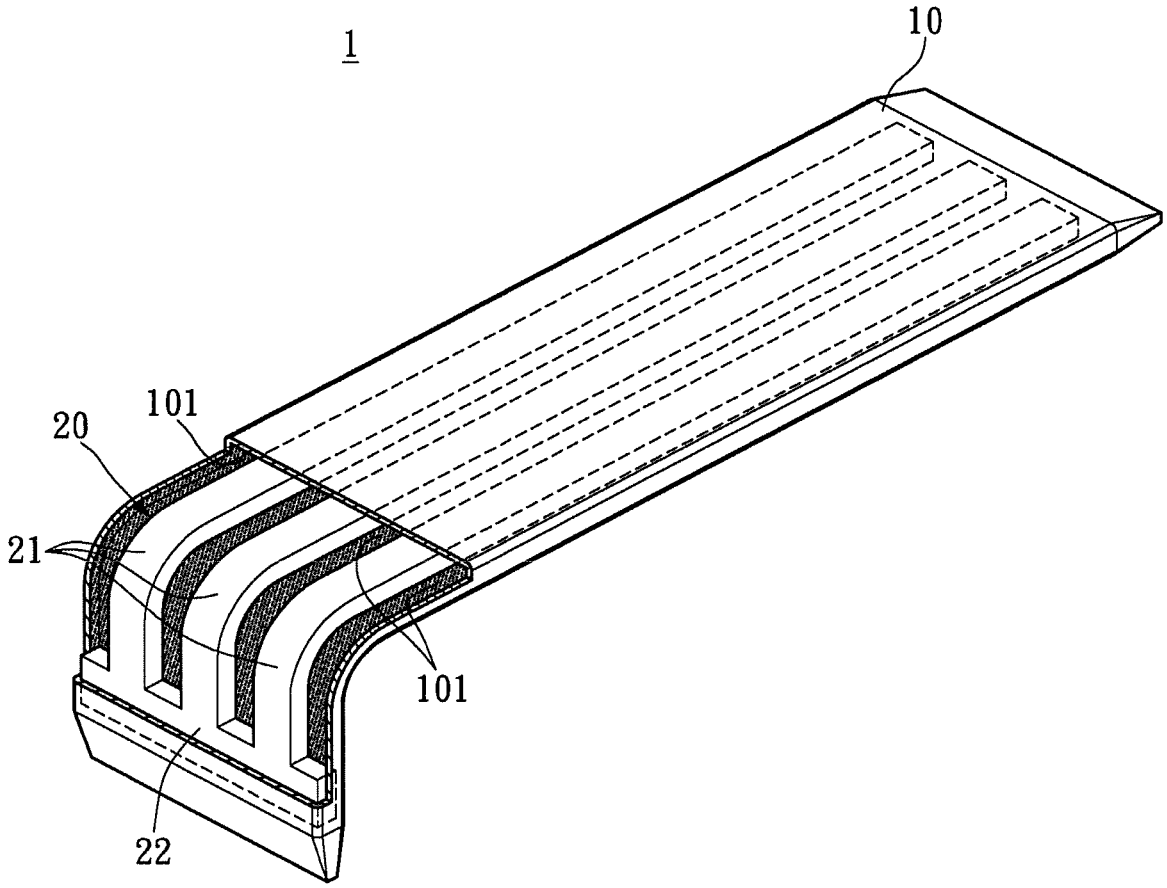
FIG. 3 is a perspective view of the flat heat pipe structure of the instant disclosure.

Please refer to FIG. 3, which is a perspective view of the flat heat pipe structure 1 of the instant disclosure. The connecting portion 22 is arranged proximate to one end of the flat tubing 10. During the flattening process of the annular tubing, the support member 20 provides structural support to the main walls 12, thus preventing the main walls 12 from deforming inwardly or crimping. Whereas during the bending process of the flat tubing 10, the support member 20 also allows the main walls 12 to maintain smooth surfaces. The other advantage of the instant disclosure is the formation of longitudinal passageways 101. The passageways 101 provide a shorter path for the working fluid to travel between the ends of the flat tubing 10.

Figure 4:
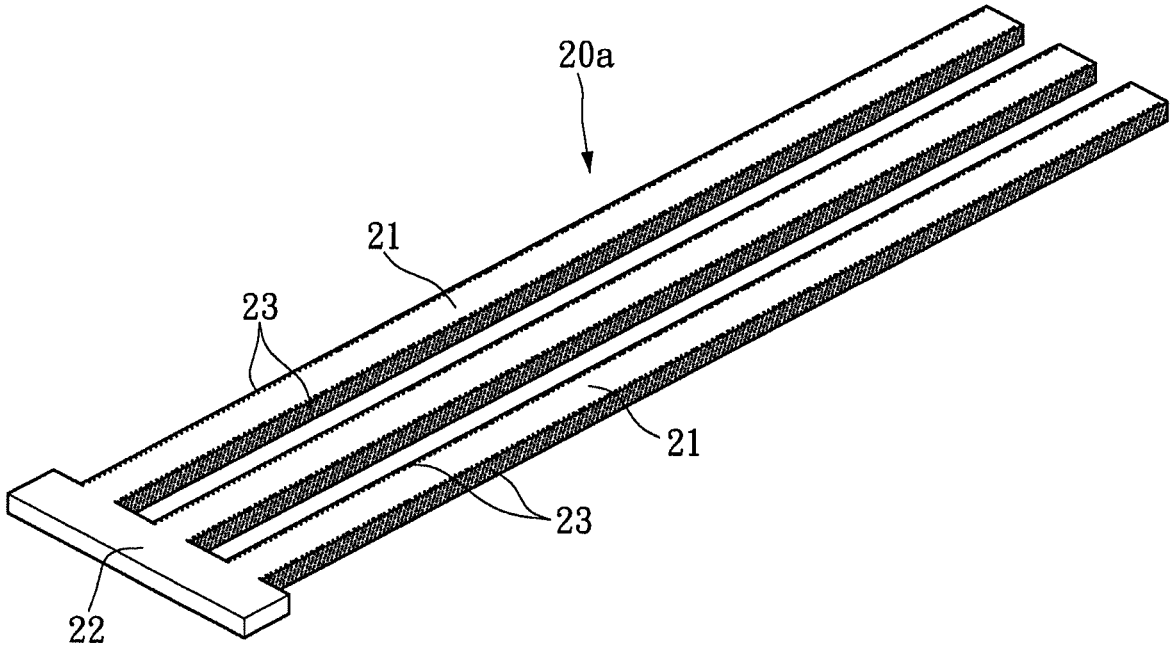
FIG. 4 is a perspective view of a support member for a second embodiment of the instant disclosure.

Please refer to FIG. 4, which is a perspective view showing an alternate support member 20*a*. For the support member 20*a*, a second capillary structure 23 is formed on the opposed side surfaces of each support arm 21. Similarly, the capillary structure 23 may be provided in various forms such as a metal mesh, grooves, a sintered body of metal powder, or a composite capillary structure.

Figure 5:
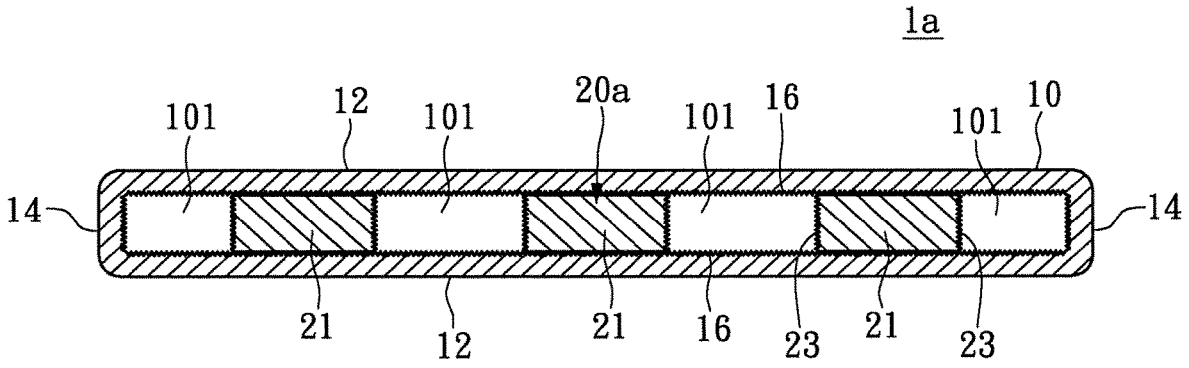
FIG. 5 is a cross-sectional view of a flat heat pipe structure of the instant disclosure having the support member shown in FIG. 4.

Please refer to FIG. 5, which is a cross-sectional view of the support member 20*a* shown in FIG. 4 and a flat heat pipe structure 1*a*. Based on the aforementioned structural features of the support member 20*a*, the capillary structures 16 and 23 cooperatively surround the passageways 101. In other words, the inners walls that define each passageway 101 are covered with capillary structures. The addition of the second capillary structure 23 further enhances the heat dissipation efficiency of the heat pipe structure 1*a*.

Figure 6:
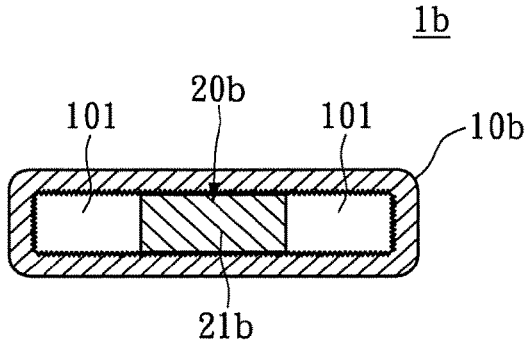
FIG. 6 is a cross-sectional view of a flat heat pipe structure for a third embodiment of the instant disclosure.

Please refer to FIG. 6, which is a cross-sectional view showing a heat pipe structure 1*b* for a third embodiment of the instant disclosure. The instant embodiment is particularly suitable in cases where a heat pipe is required to be bent. The width or the lateral dimension of the heat pipe structure 1*b* is not restricted. When the internal space 100 within the heat pipe structure 1*b* is more limited, the heat pipe structure 1*b* may include only one support arm 21*b*, as illustrated in FIG. 6. Moreover, the single support arm 21*b* and a flat tubing 10*b* cooperatively form two longitudinal passageways 101.

Based on the foregoing descriptions, the main walls 12 provide additional strength for the annular tubing during the flattening process. The instant disclosure is especially suitable in cases where a heat pipe is required to be bent. A smooth surface can be maintained at the bent portion of the flat heat pipe structure without crimping. Especially for large sized flat heat pipe structure, a smooth surface can be maintained across the main walls 12. Moreover, after the support member has been disposed in the flat heat pipe structure, the heat pipe structure can still be bent as needed. In addition, the formation of longitudinal passageways provides a short path for transporting the working fluid.

Figure 7:
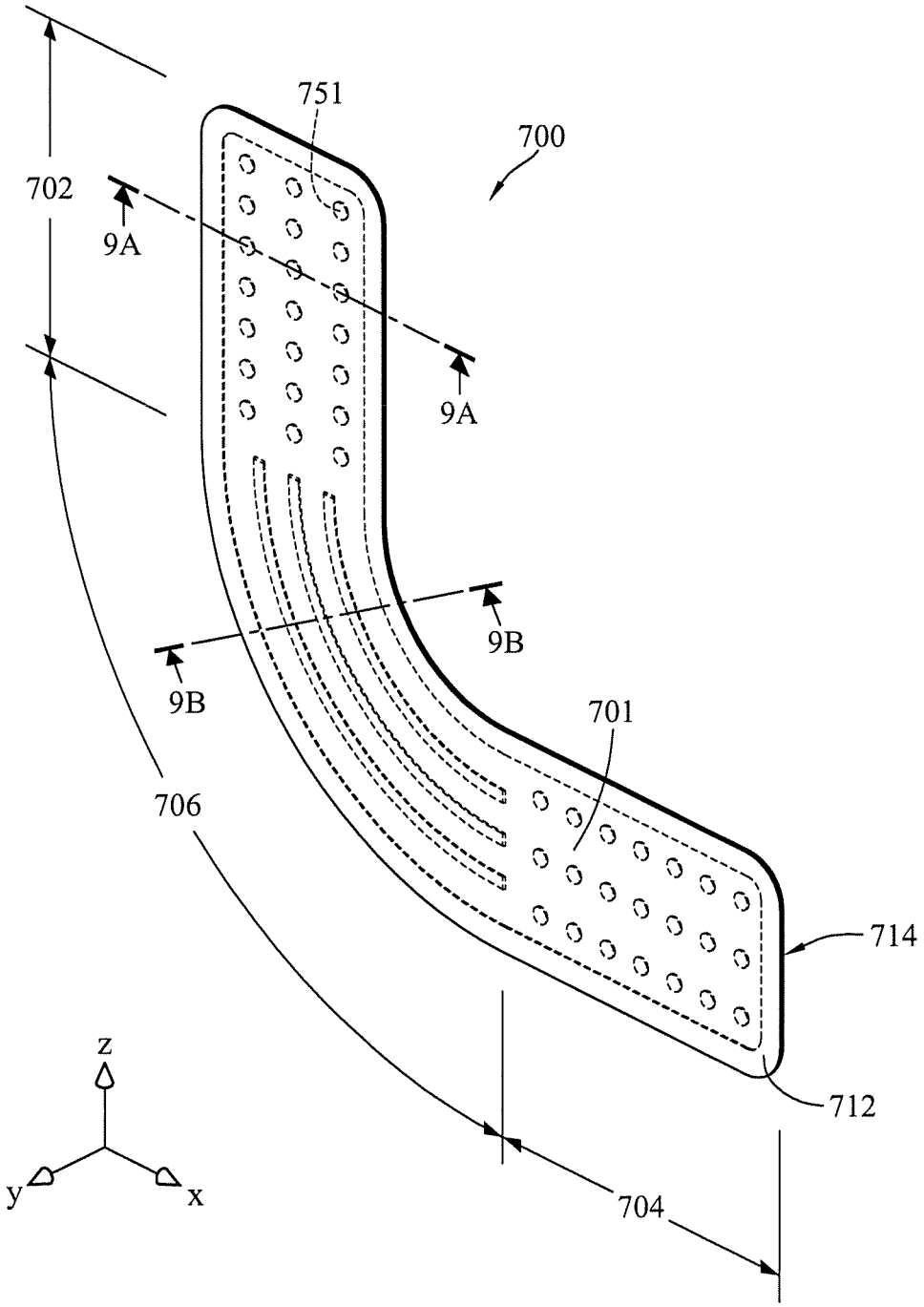
FIG. 7 illustrates an isometric view of a flat heat pipe structure, according to disclosed embodiments.
Figure 8:
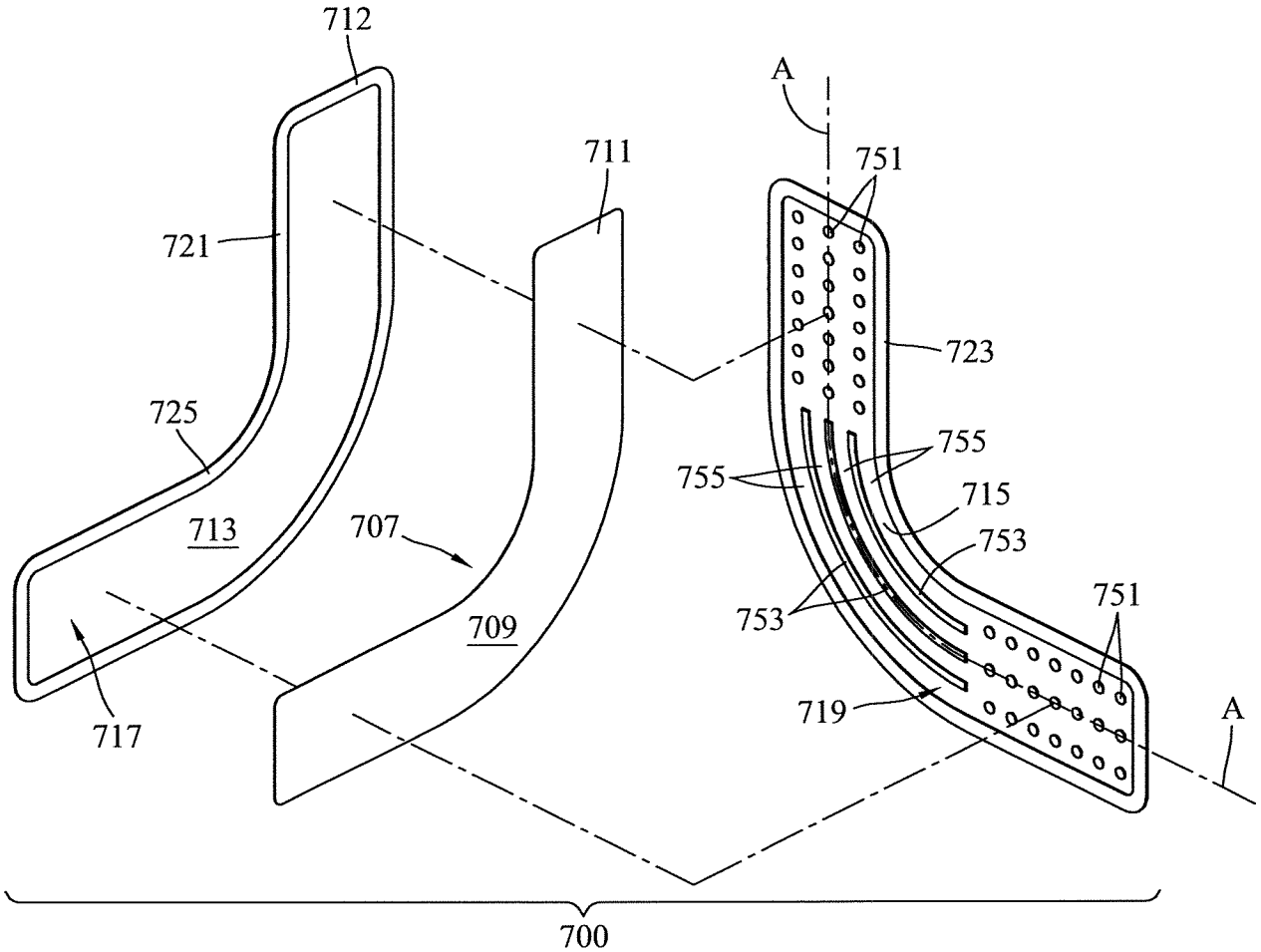
FIG. 8 illustrates an exploded view of the flat heat pipe structure of FIG. 7, according to disclosed embodiments.
Figure 9A:
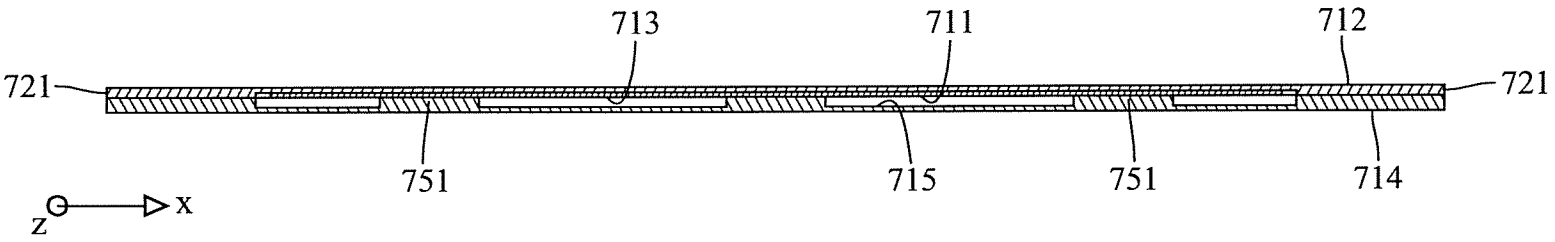
FIGS. 9A and 9B are cross-sectional view of different portions of the flat heat pipe structure of FIG. 7.
Figure 9B:
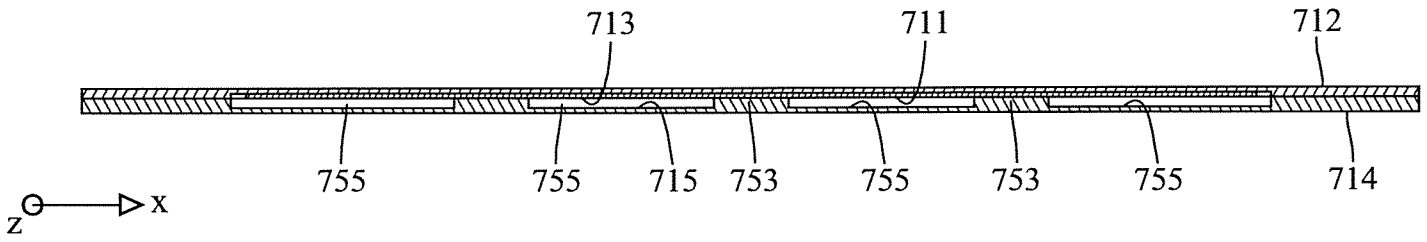

Embodiments disclosed are directed to a heat dissipation device that is substantially planar and relatively thin. As a result, the heat dissipation device occupies less space and improves heat dissipation efficiency. Embodiments are described with reference to a flat heat pipe structure, but are not limited thereto and are equally applicable to other types of heat dissipation devices, without departing from the scope of the disclosure. FIG. 7 illustrates an isometric view of a flat heat pipe structure 700, according to embodiments disclosed. FIG. 8 illustrates an exploded view of the flat heat pipe structure 700, according to embodiments disclosed. FIGS. 9A and 9B are cross-sectional views of different portions of the flat heat pipe structure 700. Referring to FIGS. 7 and 8, the flat heat pipe structure 700 includes a first or "upper" plate 712 that is coupled to a second or "lower" plate 714. The flat heat pipe structure 700 is a generally L-shaped structure that has a first portion 702, a second portion 704, and a third or "curved" portion 706 between the first portion 702 and the second portion 704.

Referring to FIGS. 8, 9A, and 9B, the first plate 712 includes a side wall 721 along the edge or rim thereof. The side wall 721 is a raised structure that extends a certain distance from an inner surface 713 of the first plate 712. The second plate 714 includes a side wall 723 along the edge or rim thereof. The side wall 723 is a raised structure that extends a certain distance from an inner surface 715 of the second plate 714. The first plate 712, the side wall 721, the second plate 714, and the side wall 723 cooperatively define a heat exchange chamber 701. A mesh 711 is disposed in the chamber 701 between the first plate 712 and the second plate 714. The inner surface 713 and the side wall 721 together define a cavity 717 that is sized or otherwise configured to receive the mesh 711. In an assembled state, the mesh 711 contacts the inner surface 713 and is arranged in the cavity 717. A bottom surface 709 of the mesh 711 is flush with the top surface 725 of the side wall 721, and a top surface 707 of the mesh 711 contacts the inner surface 713.

The inner surface 715 and the side wall 723 together define a cavity 719. The second plate 714 includes a plurality of columns 751 in the cavity 719 in the first portion 702 and the second portion 704 of the flat heat pipe structure 700. The plurality of columns 751 extend a certain distance from the inner surface 715 of the second plate 714. In the third portion 706, the second plate 714 includes a plurality of arc-shaped ridges (strips or protrusions) 753 extending between the first portion 702 and the second portion 704. Each ridge 753 has a curvature equal to the curvature of the third portion 706. In some embodiments, the plurality of columns 751 and the plurality of ridges 753 are formed using a stamping process.

When assembled, the mesh 711, the plurality of columns 751, and the plurality of ridges 753 are enclosed in the heat exchange chamber 701. The mesh 711 is received in the cavity 717 and the plurality of columns 751 and plurality of ridges 753 contact the bottom surface 709 of the mesh 711, and thereby provide support to the mesh 711. As a result, the mesh 711 is maintained in position in the cavity 717 (and the heat exchange chamber 701) and movement thereof is limited. The plurality of columns 751 and plurality of ridges 753 also provide structural support to the flat heat pipe structure 700, thereby limiting deformation of the flat heat pipe structure 700.

As illustrated, the plurality of columns 751 are arranged in a matrix in the first portion 702 and the second portion 704. The ridges 753 are arranged radially separated from each other in the third portion 706. In the arrangement illustrated in FIG. 8, a number of rows (or columns) of the columns 751 in the first portion 702 and the second portion 704 corresponds to the number of curves of the ridges 753. Further, corresponding rows (or columns) of the columns 751 in the first portion 702 and the second portion 704, and a ridge 753 in the third portion 706 are located on (or along) a same line (e.g., a curved line). For example, referring to the orientation in FIG. 8, the plurality of columns 751 in the first portion 702 are arranged in a 7×3 matrix and the plurality of columns 751 in the second portion 704 are arranged in a 3×7 matrix. The third portion 706 includes 3 ridges 753. As illustrated, a column in the matrix of the columns 751 in the first portion 702, a row in the matrix of the columns 751 in the second portion 704, and a ridge 753 in the third portion 706 are located on a same curved line A-A. It should be noted that the number of columns 751 in the first portion 702 and the number of columns 751 in the second portion 704 may be different, in some embodiments.

The plurality of ridges 753 thus provide non-intersecting channels or flow paths 755 that permit vapor generated in the flat heat pipe structure 700 to flow between the first portion 702 and the second portion 704 via the third portion 706. Due to the curved ridges 753, the vapor generated will flow more uniformly and with less impediment along the channels 755 in the third portion 706, thereby improving the cooling efficiency of the flat heat pipe structure 700. The plurality of columns 751 and the plurality of ridges 753 thus function as spacers for maintaining a desired separation between the first plate 712 and the second plate 714.

It should be noted that the plurality of columns 751 and the plurality of ridges 753 can be arranged in any desired configuration as long as the plurality of columns 751 and the plurality of ridges 753 minimize structural deformation of the flat heat pipe structure 700, minimize movement of the mesh 711, and permit vapor to flow with less impediment between the first portion 702 and the second portion 704.

During operation, a heat generating source (e.g., a CPU or similar circuit) is thermally coupled to the first plate 712 in the first portion 702. The flat heat pipe structure 700 is filled with coolant (e.g., water) and heat from the heat generating source changes a phase of the coolant from liquid to gas (vapor). The vaporized coolant circulates via convection and moves through the channels 755 to the second portion 704, which is at a lower temperature than the first portion 702. In the second portion 704, the vapor is cooled and turns back to liquid. The liquid then flows back to the first portion 702 via the mesh 711. Thus, heat from the heat generating source is dissipated.

As is understood, the flat heat pipe structure 700 is a substantially planar device that substantially occupies a single plane. The flat heat pipe structure 700 is bent or curved in only one plane (X-Z plane in FIG. 7), and thus occupies relatively less space.

Figure 10:
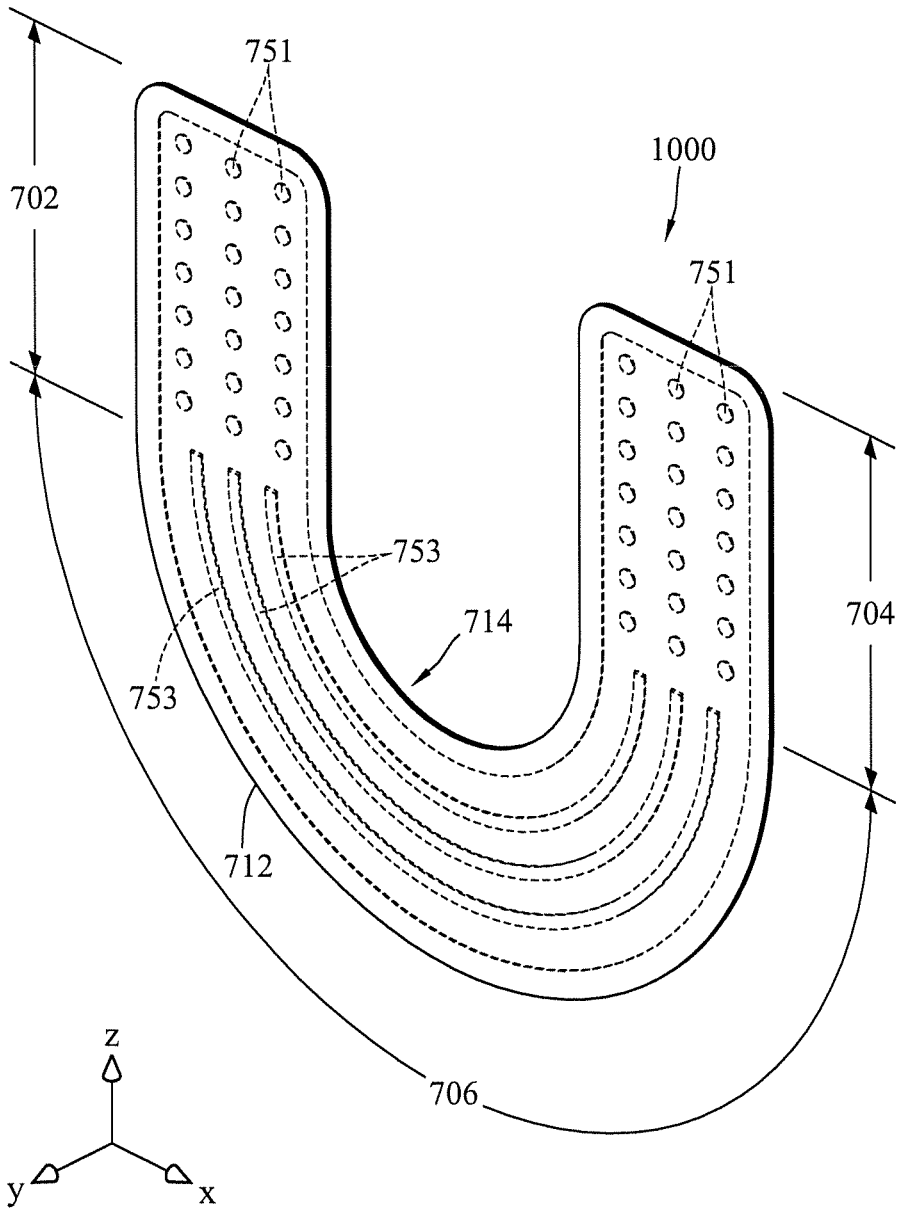
FIG. 10 illustrates an isometric view of a flat heat pipe structure, according to disclosed embodiments.
Figure 11:
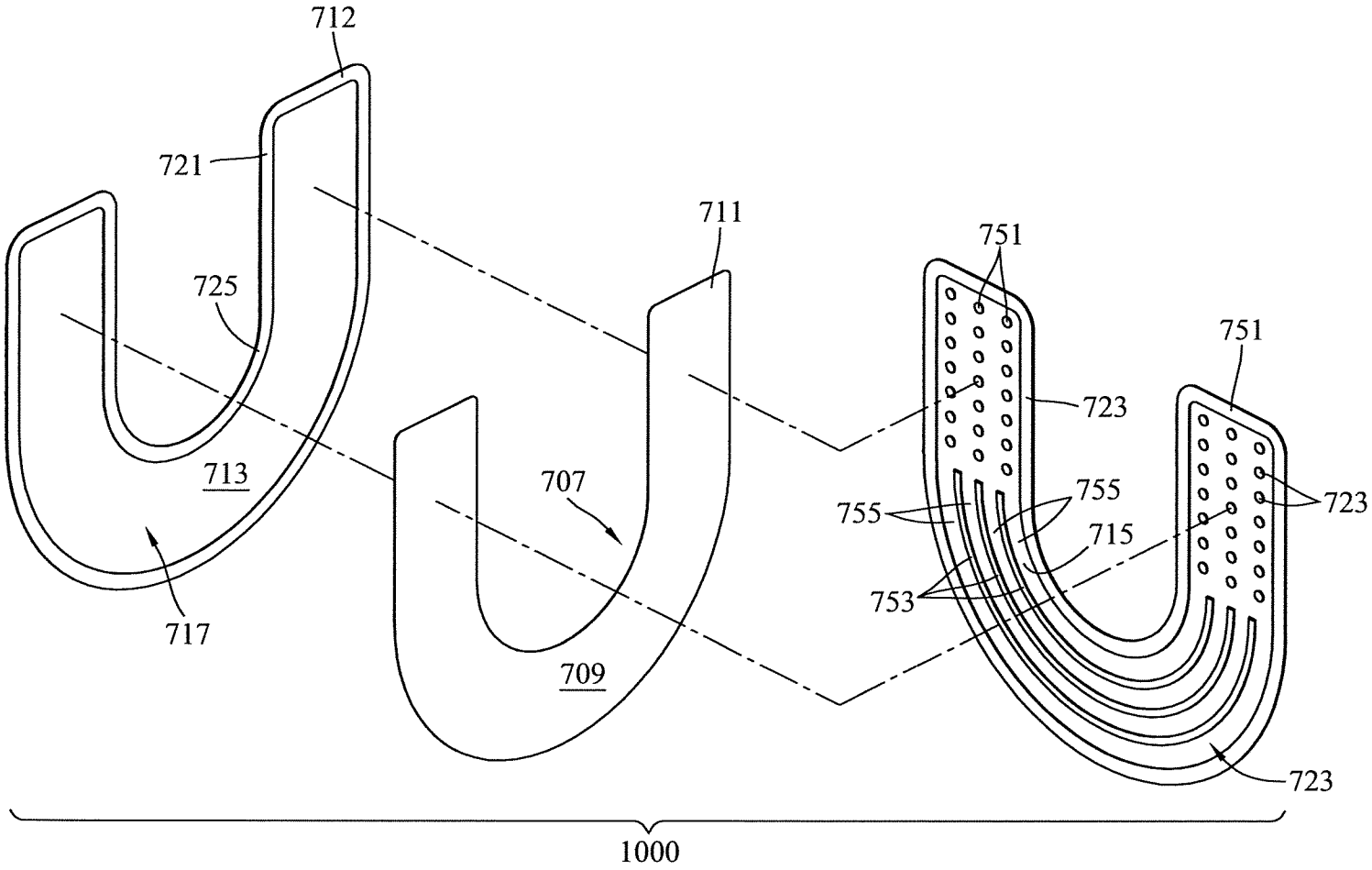
FIG. 11 illustrates an exploded view of the flat heat pipe structure of FIG. 10.

FIG. 10 illustrates an isometric view of a flat heat pipe structure 1000 according to embodiments. FIG. 11 illustrates an exploded view of the flat heat pipe structure 1000. The flat heat pipe structure 1000 may be similar in some respects to the flat heat pipe structure 700 in FIGS. 7, 8, 9A, and 9B, and therefore may be best understood with reference thereto where like numerals designate like components not described again in detail. As illustrated, the flat heat pipe structure 1000 is a U-shaped structure. The plurality of ridges 753 are semicircular in shape and are arranged radially separated from each other in the third portion 706. The mesh 711 is U-shaped and is arranged in the cavity 717. The operation of the flat heat pipe structure 1000 is similar to the flat heat pipe structure 700 and is omitted herein for the sake of brevity. Like the flat heat pipe structure 700, the flat heat pipe structure 1000 is also a planar device that substantially occupies a single plane (X-Z plane in FIG. 10) and is bent or curved in only one plane (X-Z plane in FIG. 10), and thus occupies relatively less space.

Figure 12:
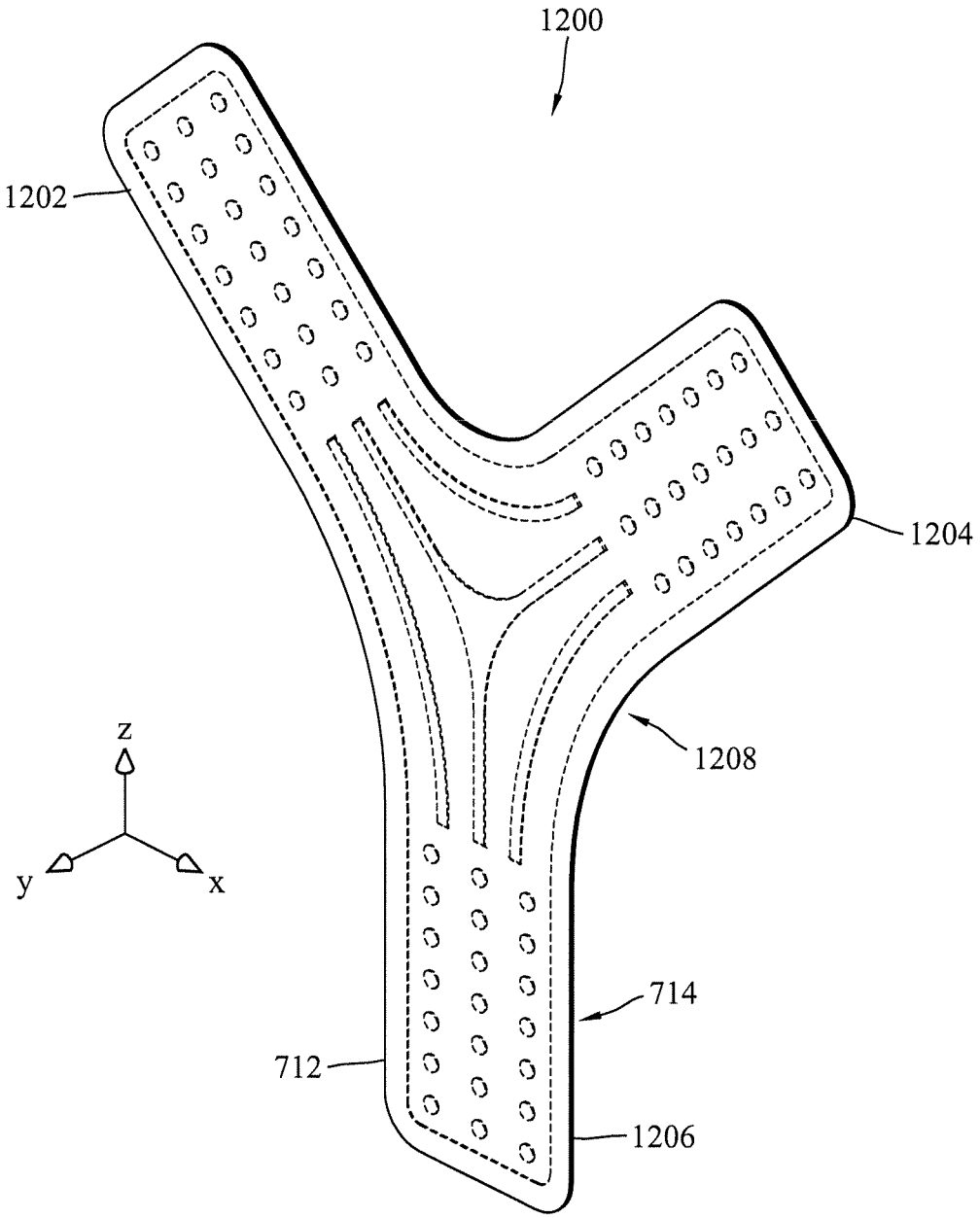
FIG. 12 illustrates an isometric view of a flat heat pipe structure, according to disclosed embodiments.
Figure 13:
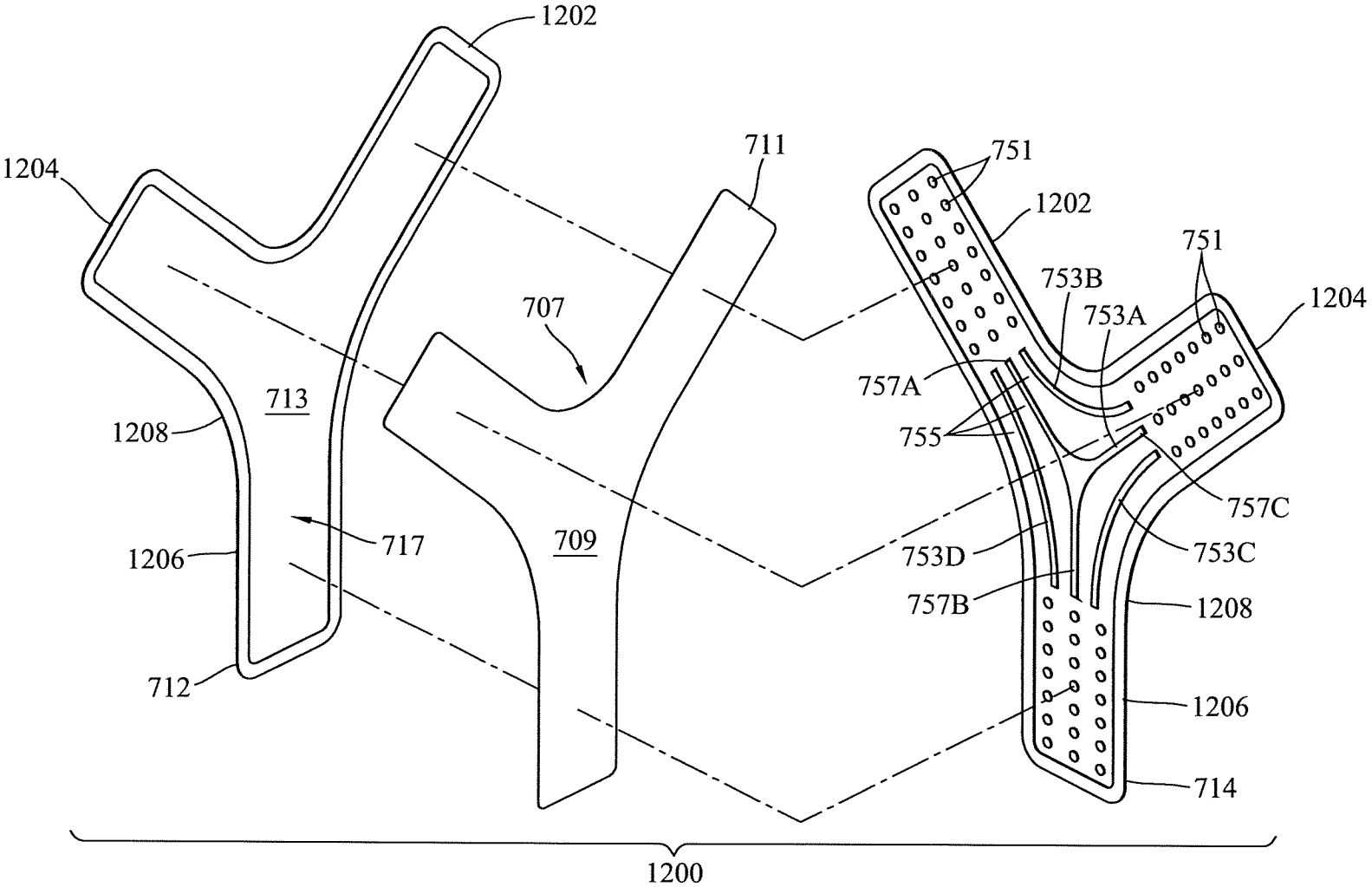
FIG. 13 illustrates an exploded view of the flat heat pipe structure of FIG. 12.

FIG. 12 illustrates an isometric view of a flat heat pipe structure 1200 according to embodiments. FIG. 13 illustrates an exploded view of the flat heat pipe structure 1200. The flat heat pipe structure 1200 may be similar in some respects to the flat heat pipe structure 700 in FIGS. 7, 8, 9A, and 9B, and the flat heat pipe structure 1000 in FIGS. 10 and 11, and therefore may be best understood with reference thereto where like numerals designate like components not described again in detail. As illustrated, the flat heat pipe structure 1200 is a star shaped or a Y-shaped structure including a first plate 712 coupled to a second plate 714 and having a mesh 711 arranged between the first plate 712 and second plate 714. Each of the first plate 712 and second plate 714 has three arms or prongs 1202, 1204, and 1206 circumferentially separated from each other and connected to a central portion 1208. The arms 1202, 1204, and 1206, and the central portion 1208 cooperatively form the arms and the central portion of the flat heat pipe structure 1200. In some embodiments, the arms 1202, 1204, and 1206 are 120° apart. However, embodiments are not limited thereto, and the arms 1202, 1204, and 1206 can be separated from each other by angles greater than or less than 120°. In some embodiments, each arm 1202, 1204, and 1206 extends a same distance from the central portion 1208. However, in other embodiments, one of the arms may extend a different distance from the central portion than the other arms.

The central portion 1208 of the second plate 714 includes a plurality of ridges 753 (indicated as 753A, 753B, 753C, and 753D). A centrally located ridge in the central portion 1208 is Y-shaped while other ridges in the central portion 1208 are arc-shaped. For example, as illustrated, a ridge 753A is Y-shaped and includes arms 757A, 757B, and 757C circumferentially separated from each other at an angle corresponding to the angle at which the arms 1202, 1204, and 1206 are separated. Ridge 753B extending between arm 1202 and arm 1204, ridge 753C extending between arm 1204 and arm 1206, and ridge 753D extending between arm 1206 and arm 1202 are each arc-shaped. The ridges 753 define a plurality of non-intersecting channels (or flow paths) 755 via which vapor generated in the flat heat pipe structure 1200 flows between the arms 1202, 1204, and 1206 through the central portion 1208. The operation of the flat heat pipe structure 1200 is similar to the flat heat pipe structures 700 and 1000, and is omitted herein for the sake of brevity. However, in the flat heat pipe structure 1200, a heat generating source can be thermally coupled to one or two arms while the third arm is at a lower temperature. Like the flat heat pipe structures 700 and 1000, the flat heat pipe structure 1200 is also a planar device that substantially occupies a single plane (X-Z plane in FIG. 12) and is bent or curved in only one plane (X-Z plane in FIG. 12), and thus occupies relatively less space.

Figure 14A:
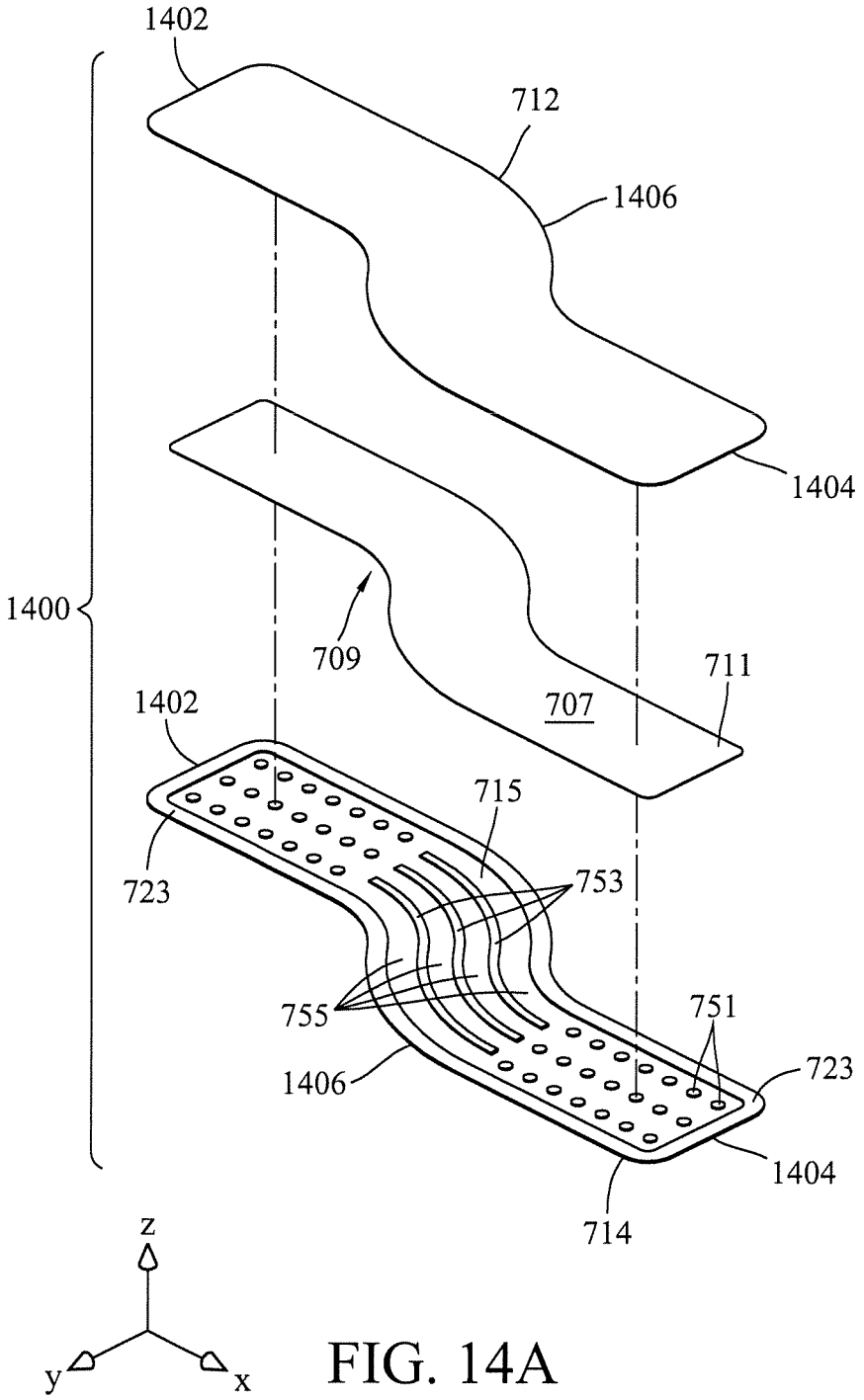
FIGS. 14A and 14B illustrate exploded views of a flat heat pipe structure, according to disclosed embodiments.
Figure 14B:
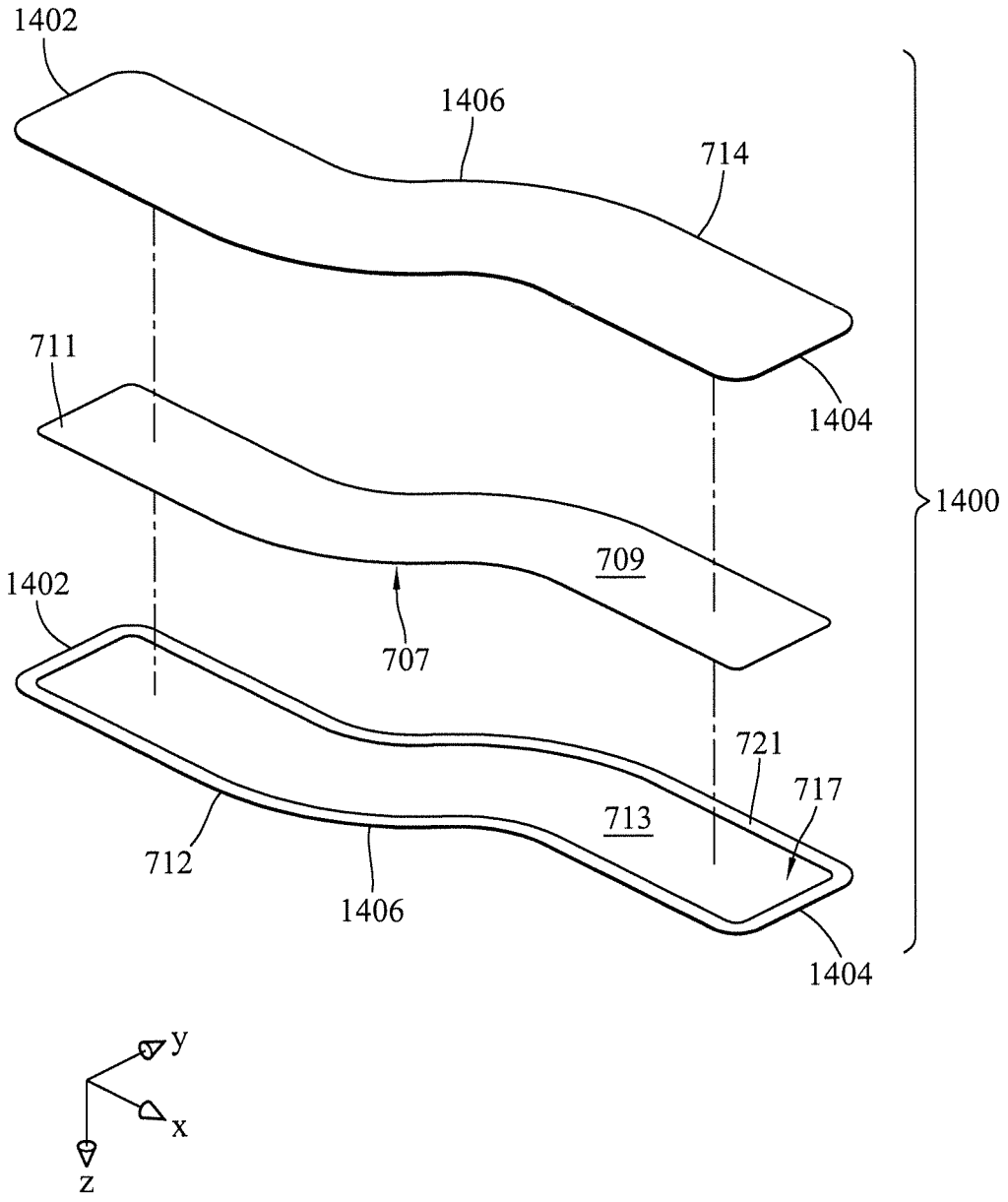

FIGS. 14A and 14B illustrate exploded views of a flat heat pipe structure 1400, according to embodiments. The flat heat pipe structure 1200 may be similar in some respects to the flat heat pipe structure 700 in FIGS. 7, 8, 9A, and 9B, the flat heat pipe structure 1000 in FIGS. 10 and 11, and the flat heat pipe structure 1200 in FIGS. 12 and 13, and therefore may be best understood with reference thereto where like numerals designate like components not described again in detail.

Figure 14C:
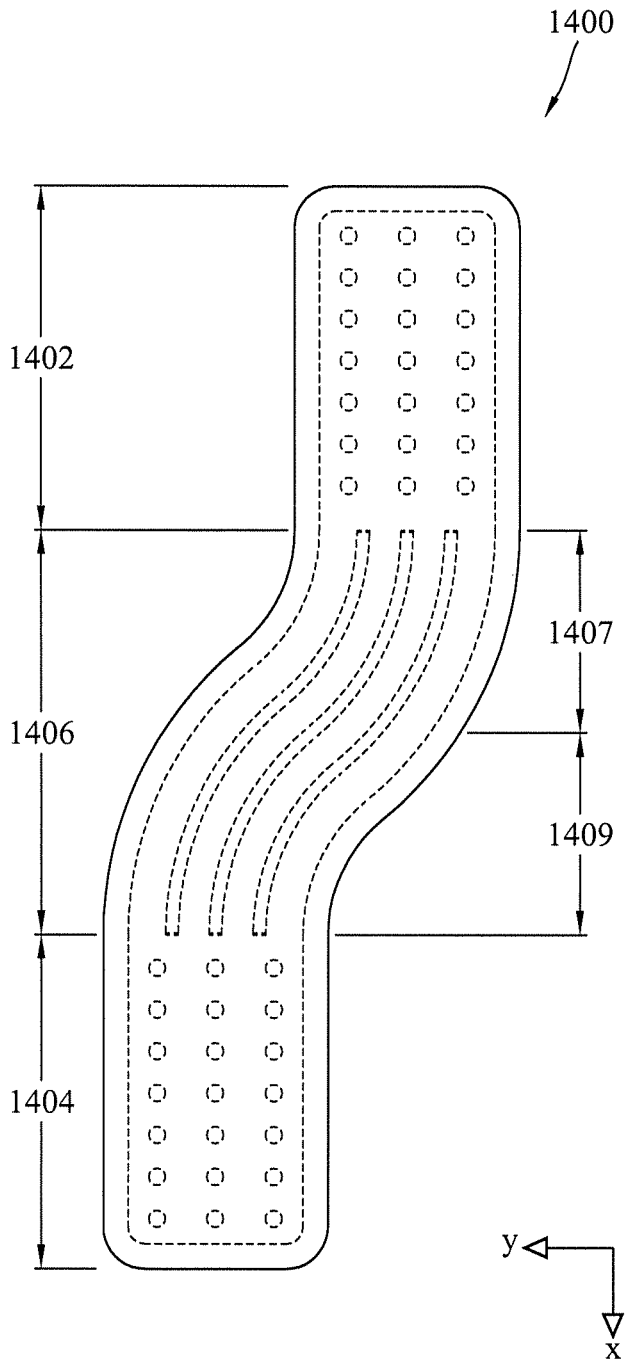
FIG. 14C illustrates a top view of an assembled flat heat pipe structure of FIG. 14A.

Each of the first plate 712 and second plate 714 has a first portion 1402 and a second portion 1404 connected to a third portion 1406. The third portion 1406 is curved and includes a convex portion and a concave portion. FIG. 14C illustrates a top view of an assembled flat heat pipe structure 1400 in FIG. 14A. As illustrated, the third portion 1406 has a generally serpentine shape and is curved at two (or more) locations. The orientation of the two curves is different at the two locations. At a first location, the third portion 1406 includes a first curved portion which is a convex portion 1407, thus having a first orientation. At a second location, the third portion 1406 includes a second curved portion which is a concave portion 1409, thus having a second orientation different from the first orientation. The convex portion 1407 connects the first portion 1402 to the concave portion 1409. The concave portion 1409 connects the convex portion 1407 to the second portion 1404. Referring to FIG. 14A, the shape of the plurality of ridges 753 corresponds to the shape of the third portion 1406. More specifically, the curvature of each of the ridges 753 is the same as the curvature of the third portion 1406. Similarly, the shape of the mesh 711 corresponds to the shape of the first plate 712 and second plate 714 such that the mesh 711 is received in the cavity 717 of the first plate 712. It should be noted that the shape of the third portion 1406 is not limited in this regard. In some embodiments, the third portion 1406 can include a concave portion connected between the first portion 1402 and a convex portion, and the convex portion connected between the concave portion and the second portion 1404. In other embodiments, the third portion 1406 can include more than one concave and/or convex portions arranged in any order.

The ridges 753 provide a plurality of non-intersecting channels (or flow paths) 755 for permitting flow of vapor between the first portion 1402 and the second portion 1404 through the third portion 1406. The operation of the flat heat pipe structure 1400 is similar to the flat heat pipe structures 700, 1000, and 1200, and is omitted herein for the sake of brevity. Like the flat heat pipe structures 700, 1000, and 1200, the flat heat pipe structure 1400 is also a planar device that substantially occupies a single plane (X-Y in FIGS. 14A, 14B, and 14C) and is bent or curved in the single one plane (X-Z plane in FIGS. 14A, 14B, and 14C), and thus occupies relatively less space.

The descriptions set forth the preferred embodiments of the instant disclosure; however, the characteristics of the instant disclosure are by no means restricted thereto. All changes, alternations, or modifications conveniently considered by those skilled in the art are deemed to be encompassed within the scope of the instant disclosure delineated by the following claims.

What is claimed is:

1. A heat dissipation device, comprising:

a first plate;

a second plate contacting the first plate, and at least partially defining a heat exchange chamber therebetween; and a mesh disposed in the heat exchange chamber, wherein each of the first plate and the second plate include a first arm, a second arm, and a third arm, and a curved portion that is centrally located between the first arm, the second arm, and the third arm, the first arm, the second arm, and the third arm being circumferentially separated from each other and each connected to the curved portion, the second plate includes a first plurality of columns arranged in the first arm, a second plurality of columns arranged in the second arm, a third plurality of columns arranged in the third arm, and a plurality of ridges arranged in the curved portion, a first ridge of the plurality of ridges includes a first arm, a second arm, and a third arm corresponding to the first arm, second arm, and third arm of the second plate, the plurality of ridges further includes second, third and fourth ridges and the first ridge is arranged between the second, third and fourth ridges, the first plurality of columns, the second plurality of columns, the third plurality of columns, and the plurality of ridges are disposed in the heat exchange chamber, both the first plate and the second plate including the respective curved portions are located in or are parallel to a single plane, the plurality of ridges are included only in the curved portion of the second plate.

2. The heat dissipation device of claim 1, wherein at least one ridge of the plurality of ridges has a same curvature as the curved portion.

3. The heat dissipation device of claim 1, wherein the first plate includes a side wall along an edge of the first plate, the first plate and the side wall cooperatively define a cavity, and the mesh is disposed in the cavity.

4. The heat dissipation device of claim 1, wherein the second plate includes a side wall along an edge of the second plate, the second plate and the side wall cooperatively define a cavity, and the first plurality of columns, the second plurality of columns, the third plurality of columns, and the plurality of ridges are disposed in the cavity.

5. The heat dissipation device of claim 1, wherein at least one column of the first plurality of columns, the second plurality of columns, and the third plurality of columns, or at least one ridge of the plurality of ridges contacts the mesh.

6. The heat dissipation device of claim 1, wherein the first plurality of columns, the second plurality of columns, and the third plurality of columns are arranged in a matrix.

7. The heat dissipation device of claim 1, wherein each arm of the first ridge is circumferentially separated from each adjacent arm by a same angle by which a corresponding arm of the second plate is separated from adjacent arms of the second plate.

8. The heat dissipation device of claim 7, wherein the second ridge extends between the first arm and the second arm of the second plate, the third ridge extends between the second arm and the third arm of the second plate, and the fourth ridge extends between the third arm and the first arm of the second plate, and each of the second, third, and fourth ridges are arc-shaped.

9. The heat dissipation device of claim 8, wherein the plurality of ridges define a plurality of channels that extend between adjacent arms of the second plate, the plurality of channels configured to permit vapor generated in the heat exchange chamber to flow between the adjacent arms.

10. The heat dissipation device of claim 1, wherein distal ends of each of the first arm, the second arm, and the third arm of the first plate and the second plate are separated from each other.

11. The heat dissipation device of claim 1, wherein distal ends of the plurality of the ridges are located adjacent the first, second, and third arms, the columns in each of the first plurality of columns, the second plurality of columns, and the third plurality of columns are arranged in a plurality of rows, and a number of rows in the first plurality of columns, in the second plurality of columns, and the third plurality of columns are a same as a number of ridges adjacent the corresponding arm.

12. The heat dissipation device of claim 11, wherein the columns in each of the first plurality of columns and the second plurality of columns are arranged in a plurality of longitudinally arranged rows, and each row of columns of the first plurality of columns, the second plurality of columns, and the third plurality of columns is collinear to a ridge of the plurality of ridges.

13. The heat dissipation device of claim 1, wherein distal ends of each of the first arm, the second arm, and the third arm of the first ridge are separated from each other.

* * * * *